US008303279B2

(12) United States Patent
Hahn

(10) Patent No.: US 8,303,279 B2
(45) Date of Patent: Nov. 6, 2012

(54) INJECTION TUBES FOR INJECTION OF FLUID INTO A SCROLL COMPRESSOR

(75) Inventor: Gregory W. Hahn, Arkadelphia, AR (US)

(73) Assignee: Danfoss Scroll Technologies, LLC, Arkadelphia, AR (US)

( * ) Notice: Subject to any disclaimer, the term of this patent is extended or adjusted under 35 U.S.C. 154(b) by 545 days.

(21) Appl. No.: 12/555,011

(22) Filed: Sep. 8, 2009

(65) Prior Publication Data

US 2011/0058971 A1 Mar. 10, 2011

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/55.1; 418/15; 418/55.5; 418/57; 417/310; 417/440

(58) Field of Classification Search ..... 418/15, 418/55.1–55.6, 57; 417/310, 440; 62/505, 62/510, 513, 196.1, 196.3
See application file for complete search history.

(56) References Cited

U.S. PATENT DOCUMENTS

| | | | | | |
|---|---|---|---|---|---|
| 4,382,370 | A | * | 5/1983 | Suefuji et al. | 62/324.1 |
| 4,475,360 | A | * | 10/1984 | Suefuji et al. | 62/503 |
| 4,496,296 | A | * | 1/1985 | Arai et al. | 418/55.5 |
| 5,996,364 | A | * | 12/1999 | Lifson et al. | 62/196.1 |
| 6,042,344 | A | * | 3/2000 | Lifson | 417/310 |
| 2005/0147514 | A1 | * | 7/2005 | Lifson et al. | 417/440 |
| 2008/0107555 | A1 | * | 5/2008 | Lifson | 418/55.1 |

FOREIGN PATENT DOCUMENTS

| | | | | | |
|---|---|---|---|---|---|
| JP | 61192890 | A | * | 8/1986 | |
| JP | 03081588 | A | * | 4/1991 | 417/310 |

* cited by examiner

*Primary Examiner* — Theresa Trieu
(74) *Attorney, Agent, or Firm* — Carlson, Gaskey & Olds, PC

(57) ABSTRACT

A scroll compressor is provided with injection tubes which extend through an upper shell and into a fixed scroll member. The injection tubes are fixed relative to the fixed scroll member, and may be press-fit or otherwise secured. This arrangement simplifies the provision of injection ports into a scroll compressor.

8 Claims, 2 Drawing Sheets

INJECTION TUBES FOR INJECTION OF FLUID INTO A SCROLL COMPRESSOR

BACKGROUND OF THE INVENTION

This application relates to a scroll compressor having injection tubes to inject a fluid into compression ports, and through a top shell.

Scroll compressors are becoming widely utilized in refrigerant compression applications. In a scroll compressor, a first scroll member has a base and a generally spiral wrap extending from the base. A second scroll member has a base and a generally spiral wrap extending from its base. The wraps of the two scroll members interfit to define compression chambers. The second scroll member is caused to orbit relative to the first scroll member, and as the two orbit the size of the compression chambers decreases and trapped refrigerant is compressed.

There are many enhancements for refrigerant cycles, such as those incorporating scroll compressors. One enhancement is the use of an economizer cycle. In an economizer cycle, refrigerant compressed by the compressor is delivered downstream to a condenser. Downstream to the condenser a portion of the refrigerant is tapped and expanded. This expanded tapped refrigerant is passed in heat exchange relationship with a main refrigerant flow in an economizer heat exchanger. This sub-cools the main refrigerant flow, and provides additional capacity at a downstream evaporator. The expanded tapped refrigerant downstream of the economizer heat exchanger is passed back into the scroll compressor through economizer injection ports. Typically, this occurs at an intermediate compression point.

In the prior art, the injection of economizer fluid, or other liquid, has occurred through a sidewall of the shell for the compressor, and into the base of the first scroll member. Complex passages, cover plates, etc., have been required. It would be desirable to simplify the provision of economizer injection into a scroll compressor.

In one known scroll compressor, the economizer injection ports extend through the top of the scroll compressor. However, in this proposed scroll compressor the first scroll member is of a type that may move axially. Thus, the first scroll member is not fixed to the economizer injection tubes, but rather slides along the tubes.

SUMMARY OF THE INVENTION

In a disclosed embodiment of this invention, the scroll compressor is provided with a non-orbiting scroll member which is fixed within a center shell. A top shell encloses the scroll compressor. The fixed scroll member provides a separation point between a suction chamber and a discharge chamber. An fluid injection port is provided by tubes extending through the top shell, and into ports in the base of the fixed scroll member. Two separate tubes may be utilized in one embodiment, or a single tube may extend through the top shell and then branch into two tubes.

These and other features of the present invention can be best understood from the following specification and drawings, the following of which is a brief description.

DETAILED DESCRIPTION OF THE PREFERRED EMBODIMENT

Figure 1:
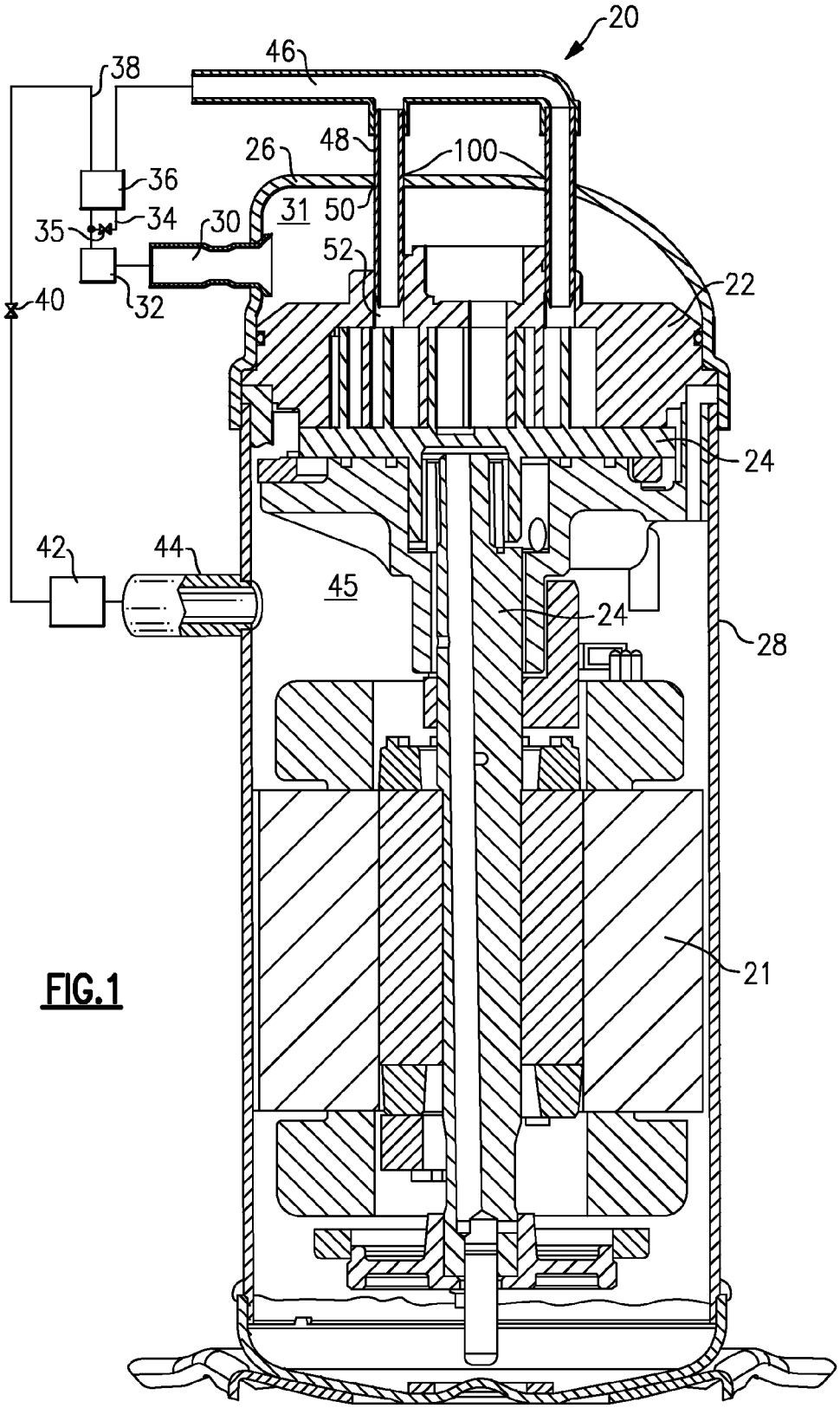
FIG. 1 shows a first embodiment of this invention.

A scroll compressor 20 is illustrated in FIG. 1. A fixed scroll member 22 is fixed between housing members 26 and 28. An orbiting scroll member 24 orbits relative to the fixed scroll member 22. A motor 21 drives orbiting scroll member 24.

The fixed scroll member 22 is sealed relative to the housing members 26 and 28 such that a suction pressure chamber 45 is formed on one side, and a discharge pressure chamber 31 is formed on an opposed side. Compression chambers are defined between the fixed scroll member 22 and the orbiting scroll member 24, and an entrapped refrigerant is compressed and delivered into the discharge pressure chamber as known. This compressed refrigerant is delivered to a discharge tube 30, and downstream to a condenser 32. From the condenser 32, a portion of the refrigerant is tapped at 34 and expanded at 35. This refrigerant passes into an economizer heat exchanger 36, in which it cools a main refrigerant flow 38. While the two flows are showed as flowing through the economizer heat exchanger 36 in the same direction, in practice, a counter-flow direction may be used. However, for illustration simplicity they are shown flowing in the same direction. The refrigerant from the main flow line 38 then passes through an expansion device 40, an evaporator 42, and returns through a suction tube 44 back into the suction chamber 45.

The expanded tapped refrigerant returns to the compressor through a manifold 46 which communicates with separate tubes 48. These tubes 48 extend through the top shell 26, and into injection ports 52 which communicate back to the compression chambers. A weld 100 may weld the openings 50 through which the tubes 48 extend through the top shell 26. The tubes 48 may be press-fit into the base of the fixed scroll 22.

This arrangement simplifies the provision of economizer fluid injection compared to the prior art.

Figure 2:
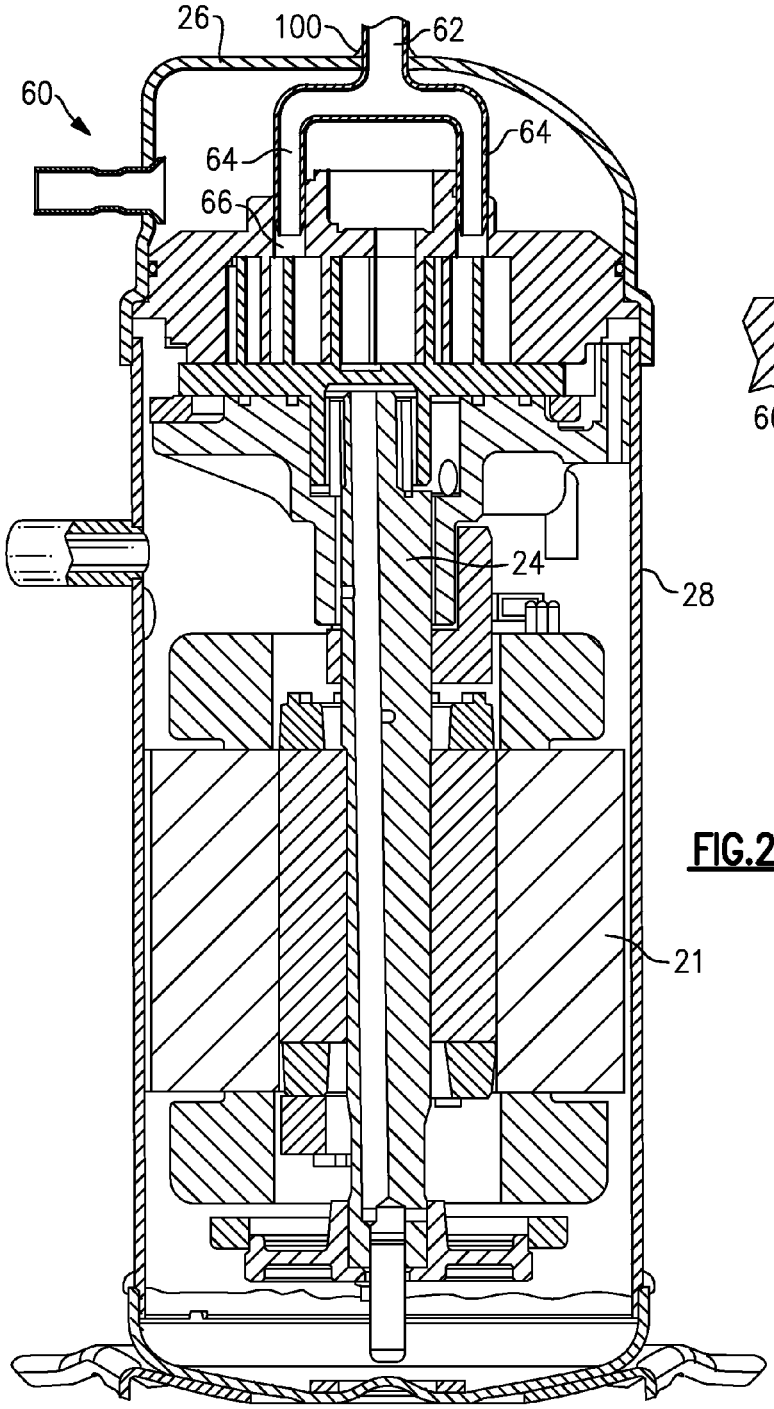
FIG. 2 shows a second embodiment of this invention.

FIG. 2 shows an embodiment 60 which is generally similar to the FIG. 1 embodiment other than only a single tube 62 extends through the upper shell 26. A weld 100 is provided as in the first embodiment. Branched flow passages 64 are press-fit into the openings 66.

Figure 3:
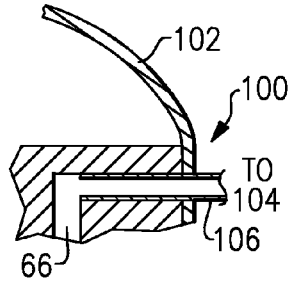
FIG. 3 shows a third embodiment of this invention.

FIG. 3 shows an embodiment 100, wherein the upper shell 102 has a tube 106 secured in a manner similar to the above embodiments, but extending through the side wall of the shell 102. Again, the tube 106 will deliver a refrigerant to the port 66. In embodiment 100, the tube 106 is connected to a source of liquid refrigerant 104 other than the economizer circuit.

While the first two embodiments are disclosed as returning an economizer fluid, any number of other injection of various liquid refrigerants, or even oil, can be accomplished by the inventive use of securing the tubes to the upper shells disclosed in this application.

Each embodiment provides a simplified assembly and structure when compared to the prior art.

While an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said wraps of said first and second scroll member interfitting to define compression chambers;

an electric motor for driving said second scroll member relative to said first scroll member;

a housing for receiving said first and second scroll members and said motor, said housing having a center shell and an upper shell, said first scroll member being fixed within said housing, and said first scroll member providing a sealed connection in said housing such that a discharge pressure chamber is defined on a first side of said first scroll member that faces said upper shell and a suction pressure chamber is defined on a second side of said first scroll member that faces said second scroll member; and injection tubes extending through said upper shell, and into injection ports in said base of said first scroll member, said injection tubes being fixed within said upper shell and in said first scroll member.

2. The scroll compressor as set forth in claim 1, wherein at least two separate tubes extend through said upper shell, and into two separate injection ports in said base of said first scroll member.

3. The scroll compressor as set forth in claim 1, wherein a single tube extends through said upper shell, and then branches into two separate tubes.

4. The scroll compressor as set forth in claim 1, wherein the injection tubes are welded to said upper shell.

5. The scroll compressor as set forth in claim 1, wherein the injection tubes are economizer injection tubes.

6. The scroll compressor as set forth in claim 1, wherein the injection tubes inject a refrigerant other than an economizer refrigerant.

7. The scroll compressor as set forth in claim 1, wherein said injection tubes extend through a top surface in said upper shell.

8. The scroll compressor as set forth in claim 1, wherein said injection tubes extend through a side wall of said upper shell.

* * * * *